US007609214B2

(12) United States Patent
Cha et al.

(10) Patent No.: US 7,609,214 B2
(45) Date of Patent: Oct. 27, 2009

(54) ANTENNA ASSEMBLY FOR PORTABLE TERMINAL

(75) Inventors: Kwang-Hwan Cha, Suwon-si (KR); Jae-Sam Youn, Suwon-si (KR); Jong-Sun Yun, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/873,922

(22) Filed: Oct. 17, 2007

(65) Prior Publication Data

US 2008/0117109 A1 May 22, 2008

(30) Foreign Application Priority Data

Nov. 17, 2006 (KR) ..... 10-2006-0113758

(51) Int. Cl.
*H01Q 1/24* (2006.01)

(52) U.S. Cl. ..... 343/702; 343/906

(58) Field of Classification Search ..... 343/702, 343/906, 900, 901
See application file for complete search history.

(56) References Cited

U.S. PATENT DOCUMENTS 4,725,845 A * 2/1988 Phillips ..... 343/702
6,933,896 B2 * 8/2005 Sward et al. ..... 343/702
2003/0210199 A1 * 11/2003 Sward et al. ..... 343/795
2004/0263398 A1 * 12/2004 Cheng ..... 343/702

FOREIGN PATENT DOCUMENTS

KR 1020030039609 5/2003
KR 1020050069004 7/2005

* cited by examiner

*Primary Examiner*—HoangAnh T Le
(74) *Attorney, Agent, or Firm*—The Farrell Law Firm, LLP

(57) ABSTRACT

An antenna assembly for a portable terminal. The antenna assembly includes an antenna housing releasably received in the portable terminal; a cam member having at least one stopping groove formed on a surface of the cam member, and connected to the antenna housing to move linearly and reciprocally in the portable terminal; a stopper coupled to the cam member in the portable terminal to interlock with the cam member; and an elastic member providing elastic force in a direction where the antenna housing is withdrawn from the portable terminal, wherein the stopper is engaged with the stopping groove to restrain the antenna housing in an interior of the portable terminal when the antenna housing is received and locked in the portable terminal. Since the antenna assembly can be carried while being received and locked in the portable terminal, it is possible to improve design and portability of the portable terminal, and to ensure better communication quality.

14 Claims, 11 Drawing Sheets

ANTENNA ASSEMBLY FOR PORTABLE TERMINAL

PRIORITY

This application claims priority an application filed in the Korean Industrial Property Office on Nov. 17, 2006 and assigned Serial No. 2006-0113758, the contents of which are incorporated herein by reference.

BACKGROUND OF THE INVENTION

1. Field of the Invention

The present invention generally relates to a portable terminal, and more particularly to an antenna apparatus for a portable terminal.

2. Description of the Related Art

In general, a portable terminal refers to a device for providing wireless communication between users or between a user and a service provider through telecommunication base stations. Users can use various functions, for example, voice communication, short message sending, mobile banking, watching television (TV), and various contents, such as online games, Video On Demand (VOD), etc., through a portable terminal.

Portable terminals are generally classified into bar-type terminals, flip-type terminals, and folder-type terminals according to their appearances. Bar-type terminals have input/output devices, such as a communication circuit, a transmitter, a receiver, etc., in a housing. Flip-type terminals have a bar-type body on which a flip cover is mounted. Folder-type terminals have a pair of housings coupled to each other to rotatably fold on and unfold from each other, on which input and output devices are dispersedly mounted, respectively. On the other hand, sliding-type terminals and the like have recently appeared, and are used along with folder-type terminals for improving portability of portable terminals and convenience of users. There are persistent efforts to satisfy various needs of users.

In addition, mobile communication services for a portable terminal, such as online games, transmission of moving picture files, mobile banking, VOD, Digital Multimedia Broadcasting (DMB), etc., have been diversified. As use of portable terminals becomes general and needs of users vary, it is possible to commercialize services for providing various contents through portable terminals. As a result, mobile communication services have been diversified.

On the other hand, as DMB receiving functions, as well as mobile communication services, are added to portable terminals, antenna assembly installation difficulties have occurred in portable terminals. In particular, frequency bands of 800 MHz or 1.8 GHz are typically used for mobile communication services according to service providers. In DMB services, the frequency band of 174~216 MHz is typically used for terrestrial DMB services, and the frequency band of 2.6 GHz is typically used for satellite DMB services. In order to use different frequency bands for services, such as mobile communication and DMB services and the like, using a portable terminal, an antenna apparatus which is suitable for each service is needed.

However, it is very difficult to equip a portable terminal with antenna apparatuses which have operating characteristics distinguished from each other. Even though such antennae are equipped in portable terminals, these prevent compactness of portable terminals. Further, portable terminals, which have separate antennae for receiving DMB, have appeared. A separate antenna may be detachably assembled with a portable terminal according to necessity of a user. However, since users must carry a separate antenna module as well as the portable terminal, separate antennae causes degradation of portability of portable terminals.

Furthermore, in portable terminals having either a mobile communication service or a DMB service, an external antenna protrudes out of the portable terminals, thereby hurting the aesthetic quality of the portable terminals. In addition, the external antenna may be damaged. An internal antenna has a problem of degrading communication quality in comparison with the external antenna.

SUMMARY OF THE INVENTION

Accordingly, the present invention has been made to solve the above-mentioned problems occurring in the prior art, and it is an aspect of the present invention to provide an antenna assembly for a portable terminal, which can improve the portability of the portable terminal.

Another aspect of the present invention provides an antenna assembly for a portable terminal, which can improve the design of the portable terminal and prevent a danger of being damaged.

Still another aspect of the present invention provides an antenna assembly for a portable terminal, which can be withdrawn from the portable terminal according user's necessity, thereby ensuring better communication quality.

In accordance with one aspect of the present invention, there is provided an antenna assembly for a portable terminal, the antenna assembly including an antenna housing releasably received in the portable terminal; a cam member having at least one stopping groove formed on a surface of the cam member, and connected to the antenna housing to move linearly and reciprocally in the portable terminal; a stopper coupled to the cam member in the portable terminal to interlock with the cam member; and an elastic member providing elastic force in a direction where the antenna housing is withdrawn from the portable terminal, wherein the stopper is engaged with the stopping groove to restrain the antenna housing in an interior of the portable terminal when the antenna housing is received and locked in the portable terminal.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Preferred embodiments of the present invention will be described with reference to the accompanying drawings. In the following description of the present invention, descriptions of known functions and configurations are omitted to avoid making the subject matter of the present invention unclear.

Figure 8:
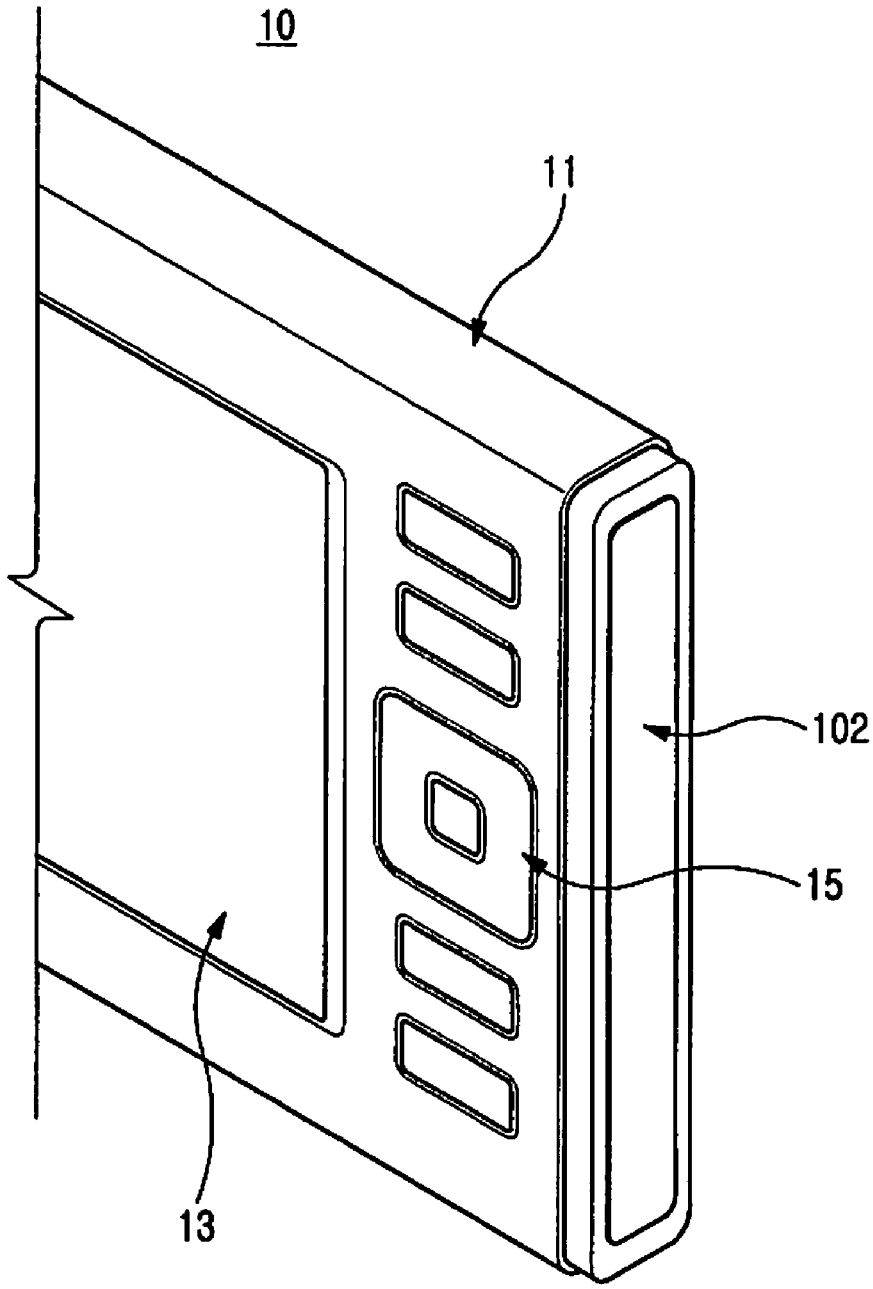
FIG. 8 is a perspective view showing the antenna assembly mounted on the portable terminal shown in FIG. 1.
Figure 9:
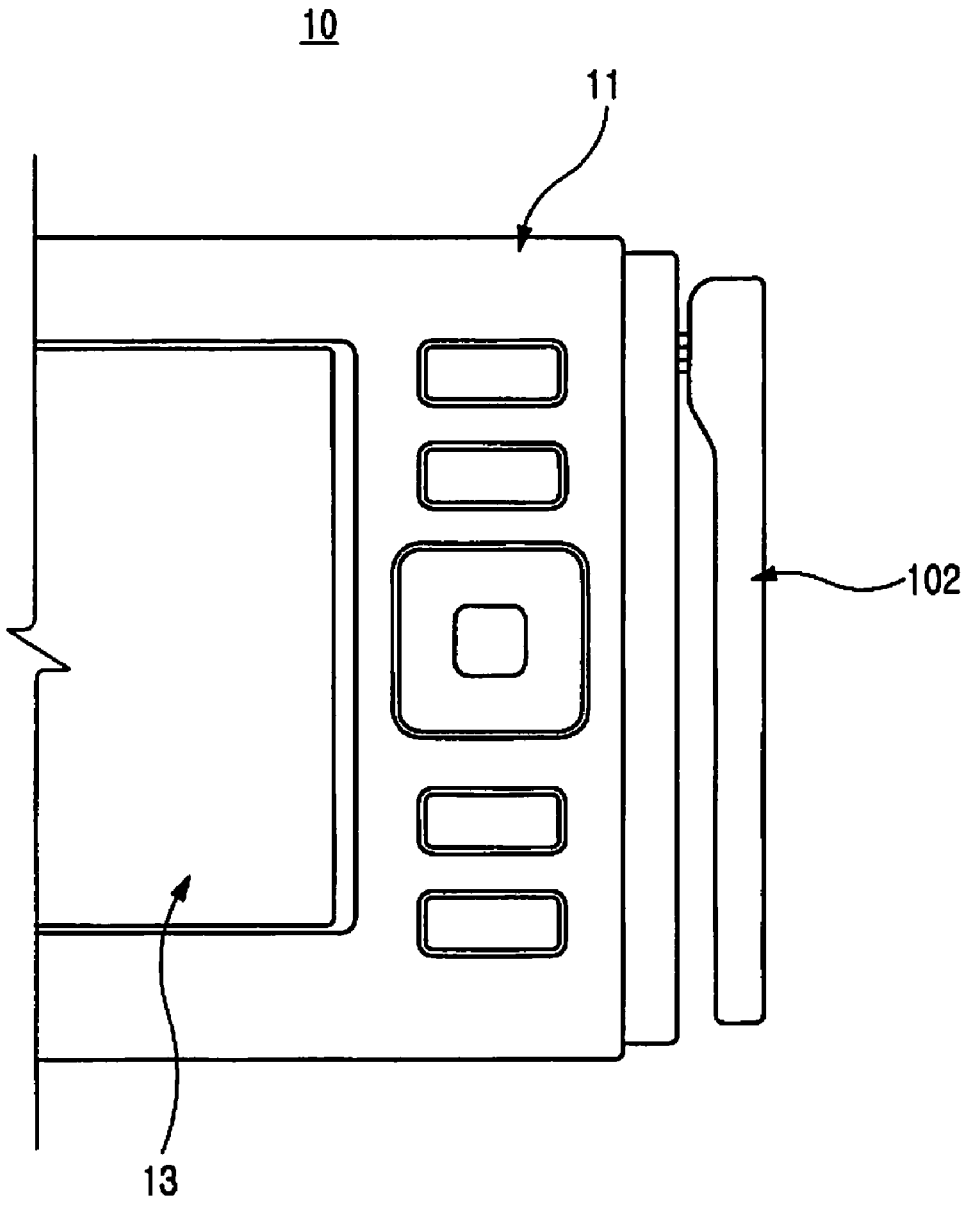
FIG. 9 is a front view showing the antenna assembly which is withdrawn from the portable terminal shown in FIG. 8.
Figure 10:
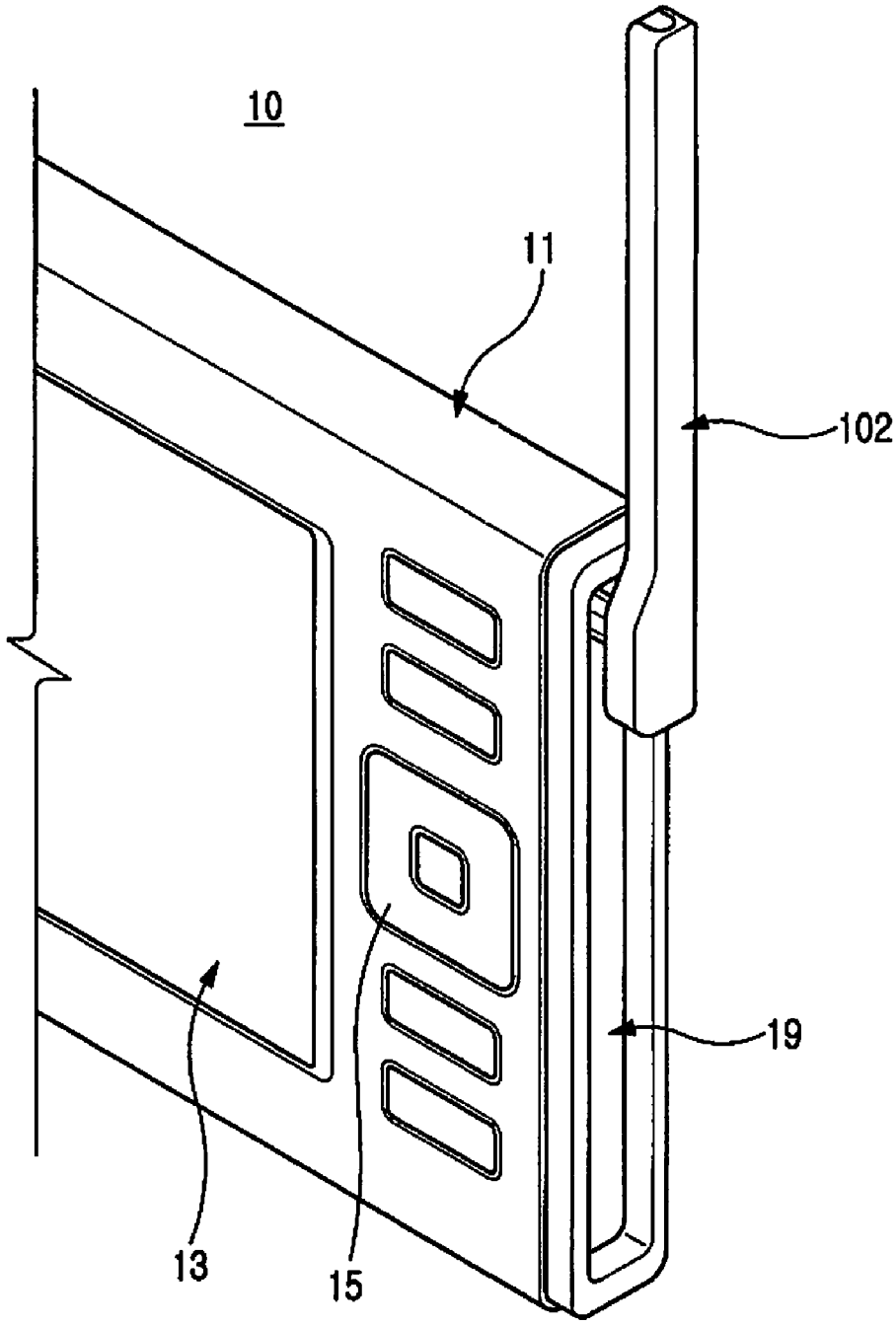
FIG. 10 is a perspective view showing the antenna assembly shown in FIG. 9, in which the antenna assembly rotates with respect to the body of the portable terminal.

Referring to FIGS. 1 to 4, in an antenna assembly 100 for a portable terminal according to the present invention, an antenna housing 102 is releasably received in a housing 11 (see FIG. 8) of a portable terminal 10 (see FIG. 8). The antenna housing 102 is locked in the portable terminal 10 by means of a cam member 104 and a stopper 105. The antenna housing 102 can be released from the housing 11 of the portable terminal when a user presses the antenna housing 102. The antenna housing 102 released from the housing 11 of the portable terminal can be rotated by any desired angle.

Figure 11:
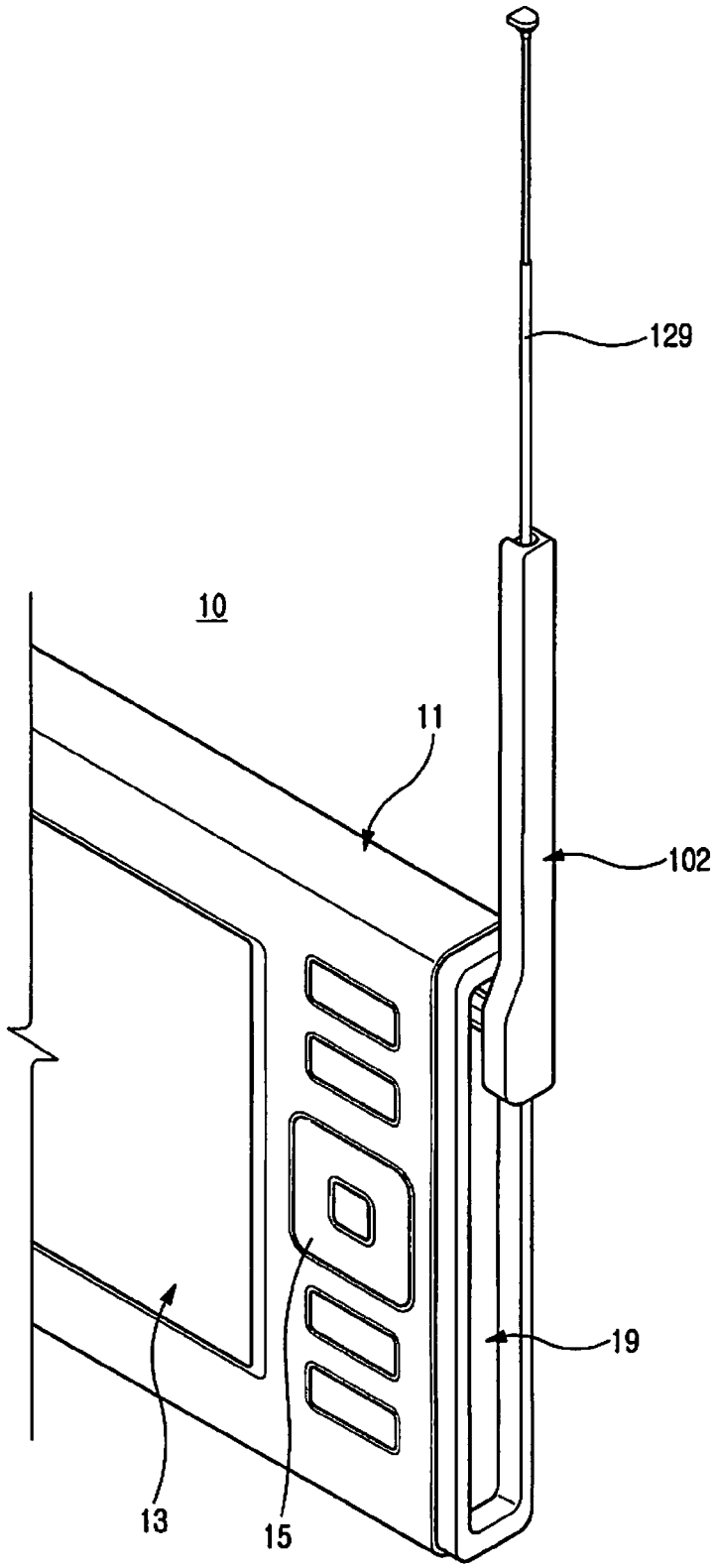
FIG. 11 is a perspective view showing the antenna assembly shown in FIG. 10, in which a rod antenna extends out of an antenna housing.

The antenna housing 102 includes a rod antenna 129 coupled thereto so the rod antenna 129 can be inserted into/withdrawn from the antenna housing 102, as shown in FIG. 11. Considering convenience of assembling, the antenna housing 102 includes an inner case 102*a* and an outer case 102*b*, and is releasably received in the housing 11 of the portable terminal 10. In order to releasably receive the antenna housing 102 in the housing 11 of the portable terminal 10, the antenna assembly 100 includes a connection shaft 103 connected to a side of the antenna housing 102. The connection shaft 103 is mounted on the housing 11 of the portable terminal 10 in such a manner of being inserted into/withdrawn from the housing 11 and also rotating with respect to the housing 11 of the portable terminal 10. Therefore, as being released from the housing 11 of the portable terminal 10, the antenna housing 102 can be rotated about the connection shaft 103 by any desired angle.

The connection shaft 103 has a rotation member 139 mounted on an end thereof and fixed to the antenna housing 102, which rotates about the connection shaft 103.

Figure 1:
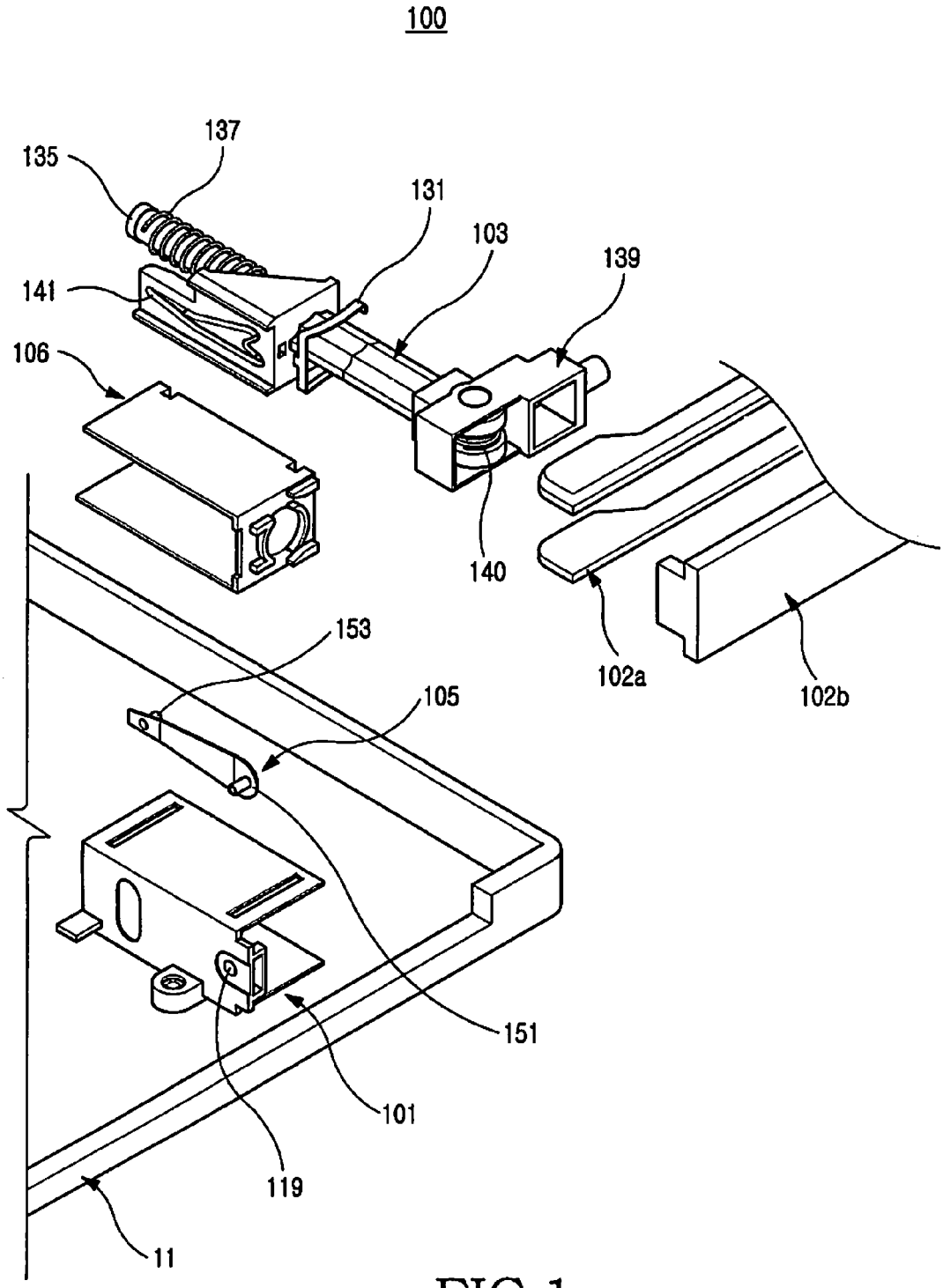
FIG. 1 is a exploded perspective view showing an antenna assembly for a portable terminal according to the present invention.
Figure 2:
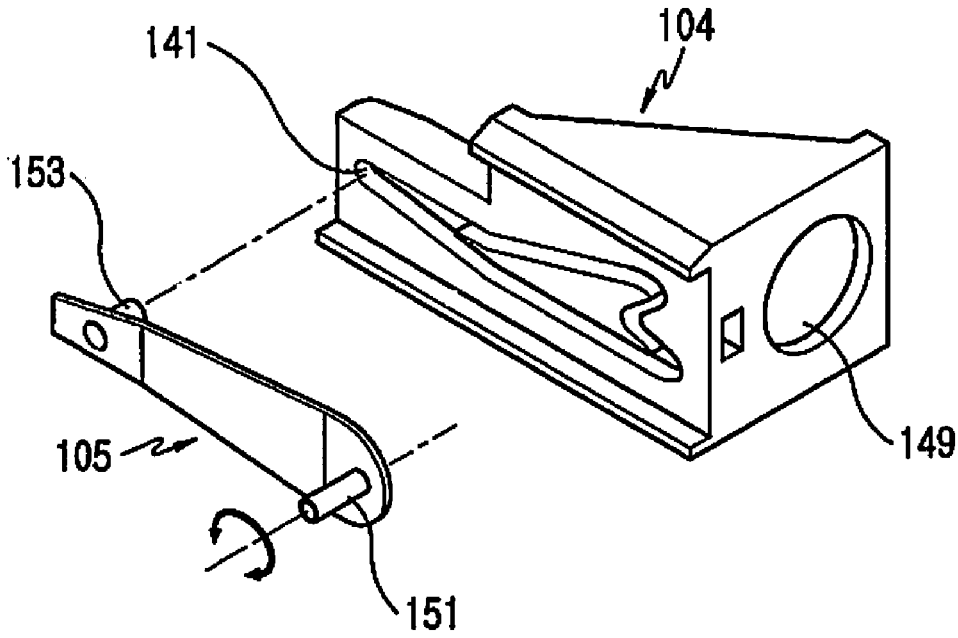
FIG. 2 is a perspective view showing a cam member and a stopper of the antenna assembly shown in FIG. 1.
Figure 3:
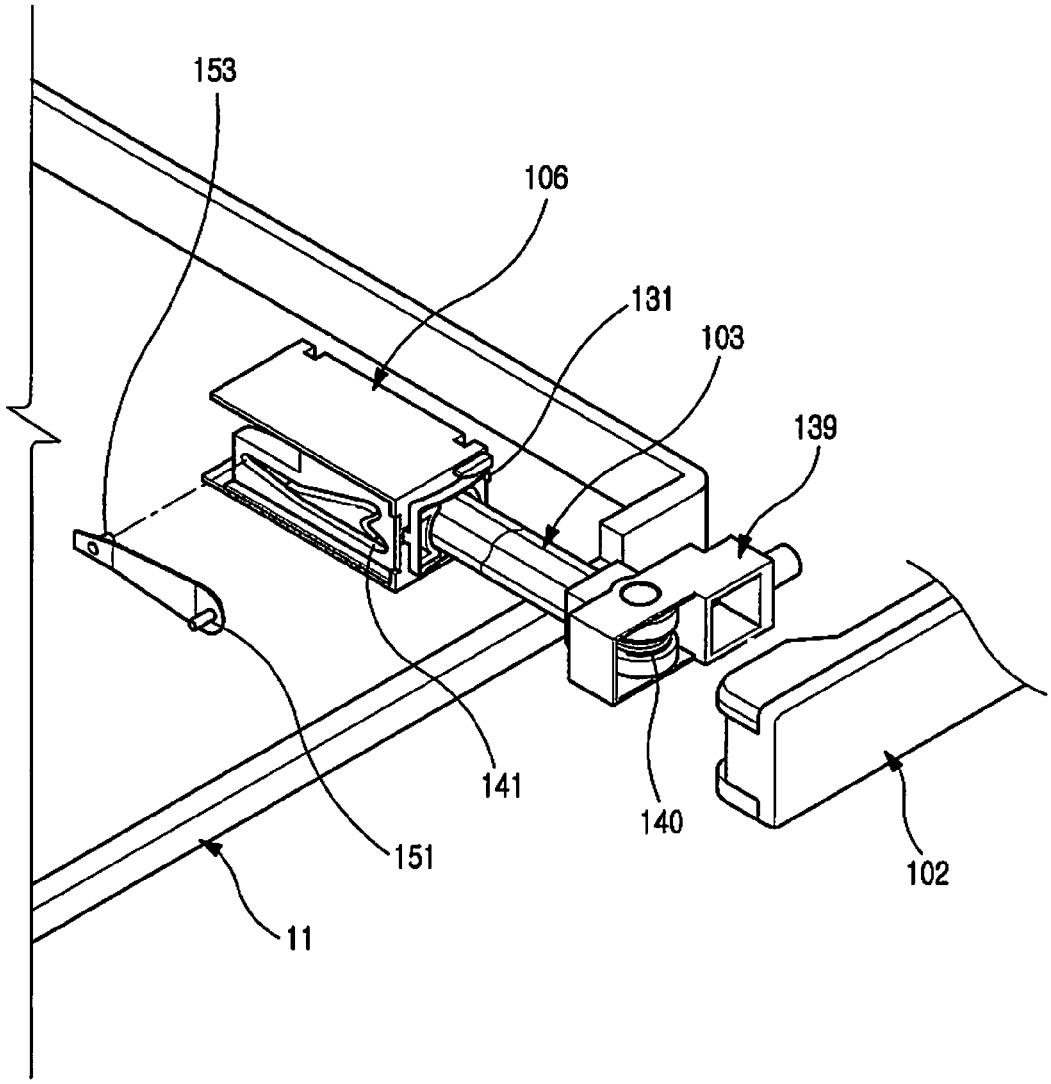
FIG. 3 is a perspective view showing a part of the antenna assembly shown in FIG. 1.
Figure 4:
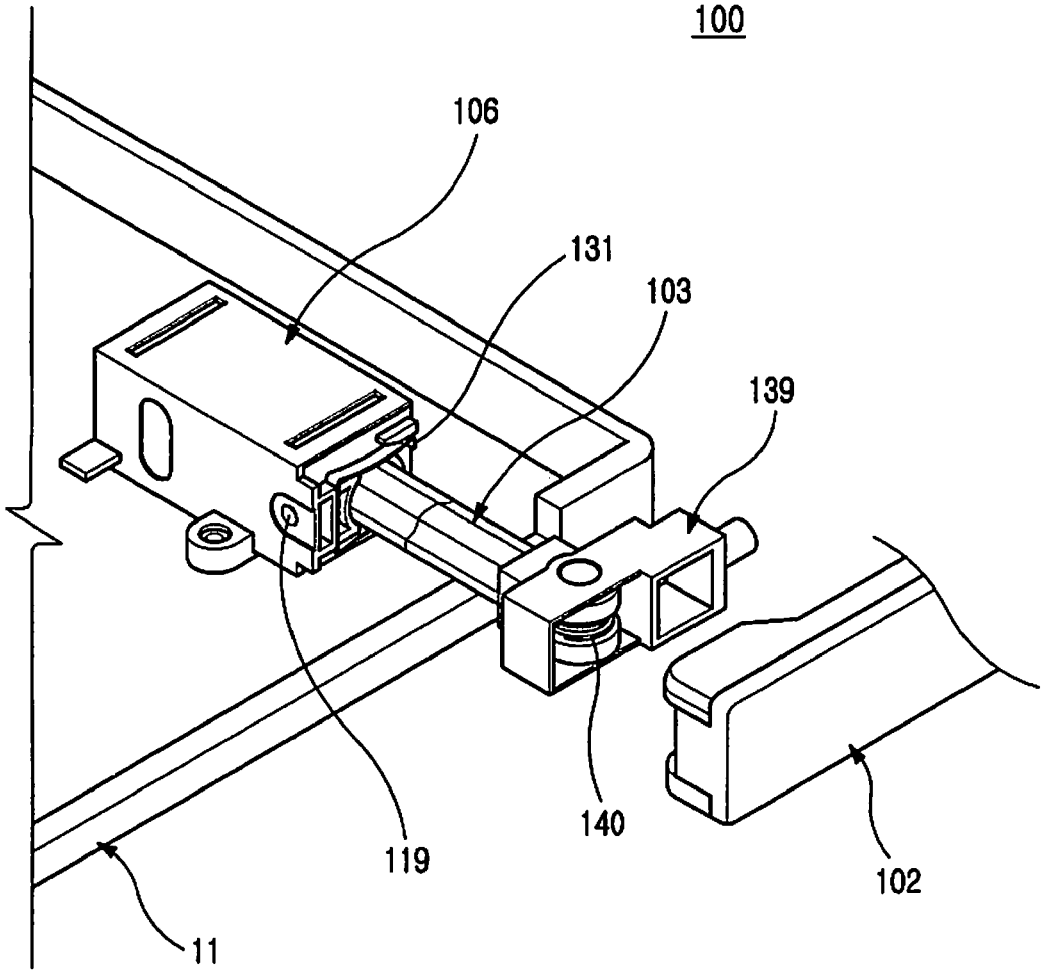
FIG. 4 is a perspective view showing the antenna assembly shown in FIG. 1, in which elements of the antenna assembly are assembled with one another.

The connection shaft 103 is connected to an end of the antenna housing 102, and is provided with a torsion spring 140 at one end thereof, as shown in FIG. 3. When the antenna housing 102 is received and locked in the housing 11 of the portable terminal 10, the torsion spring 140 provides rotating force for the rotation member 139 so the antenna housing 102 comes into close contact with the housing 11 of the portable terminal 10.

The connection shaft 103 has a plurality of flat surfaces formed on an outer peripheral surface in a circumferential direction and has a polygonal configuration in section. A plate spring 131 pressing the outer peripheral surface of the connection shaft 103 is mounted on the housing 11 of the portable terminal 10. When the antenna housing 102 rotates when being released from the housing 11 of the portable terminal 10, the plate spring 131 presses the outer flat peripheral surface of the connection shaft 103, so the antenna housing 102 stably remains stopped. The outer flat peripheral surface of the connection shaft 103 may be changed into a curved groove. When a groove is formed on the outer peripheral surface of the connection shaft 103, the antenna housing 102 can remain stopped more stably.

On the other hand, the housing 11 of the portable terminal has a tie rod 135 mounted therein to support operation of the connection shaft 103 inserted into and withdrawn from the housing 11. The tie rod 135 extends into the connection shaft 103, and is fixed to the housing 11 of the portable terminal 10.

Further, the cam member 104 is connected to the antenna housing 102 by means of the connection shaft 103, and moves linearly and reciprocally in the housing 11 of the portable terminal 10. The cam member 104 has a hole 149 formed therein, through which the tie rod 135 extends into the connection shaft 103. Particularly, the tie rod 135 is inserted into the connection shaft 103 through the hole 149 of the cam member 104.

The cam member 104 has a guide groove 141 formed on a surface thereof, which has a closed curve trajectory. The stopper 105 is rotatably mounted inside the housing 11 of the portable terminal 10. As the cam member 104 moves linearly and reciprocally, a part of the stopper 105 moves along the guide groove 141.

The stopper 105 is a plate extending in one direction. The stopper 105 has a rotation pin 151 formed on an end of a surface thereof, and a stopping protrusion 153 formed on the other end of the other surface thereof. Since the rotating pin 151 is rotatably coupled to the housing 11 of the portable terminal 10, the stopper 105 can rotate with respect to the housing 11 of the portable terminal 10, and the stopping protrusion 153 is located inside the guide groove 141. As the stopping protrusion 153 moves along the guide groove 141, the stopping member 105 rotates about the rotation pin 151.

The antenna assembly 100 has an elastic member 137 wound on the tie rod 135. The elastic member 137 has one end supported by the housing 11 of the portable terminal 10 and the other end supported by the cam member 104 to provide elastic force. The connection shaft 103 receives elastic force from the elastic member 137 through the cam member 104, and is withdrawn from the housing 11 of the portable terminal 10.

The guide groove 141 includes the first and second stopping grooves 141*a* and 141*c*. When the stopping protrusion 153 is located in one of the first and second stopping grooves 141*a* and 141*c*, the antenna housing 102 is restrained from being withdrawn from the housing 11 of the portable terminal 10.

For example, when the antenna housing 102 is withdrawn from the housing 11 of the portable terminal 10, the stopping protrusion 153 is located in the first stopping groove 141*a* to restrain the antenna housing 102 from being withdrawn from the housing 11 of the portable terminal 10 any more even though the elastic member 137 provides the elastic force. Further, when the antenna housing 102 is received in the housing 11 of the portable terminal 10, the stopping protrusion 153 is located in the second stopping groove 141*c* so as to keep the antenna housing 102 received and locked in the housing 11 of the portable terminal 10, even though the elastic member 137 provides the elastic force for the antenna housing 102.

In order to prevent the cam member 104, the tie rod 135, the elastic member 137, the stopper 105, etc., from interfering with other structural elements in the housing 11 of the portable terminal 10, the antenna assembly 100 may have a guide member 106 and a cam housing 101.

The guide member 106 encloses the stopper 105, the cam member 104, the elastic member 137, and the tie rod 135, and guides the linearly reciprocal movement of the cam member 104. The cam housing 101 encloses the guide member 106 and is secured to the interior of the housing 11 of the portable terminal 10. The cam housing 101 has a rotation hole 119 so the rotation pin 151 of the stopper 105 is rotatably coupled to the cam housing 101. Accordingly, the stopper 105 is rotatably coupled to the housing 11 of the portable terminal 10.

Figure 5:
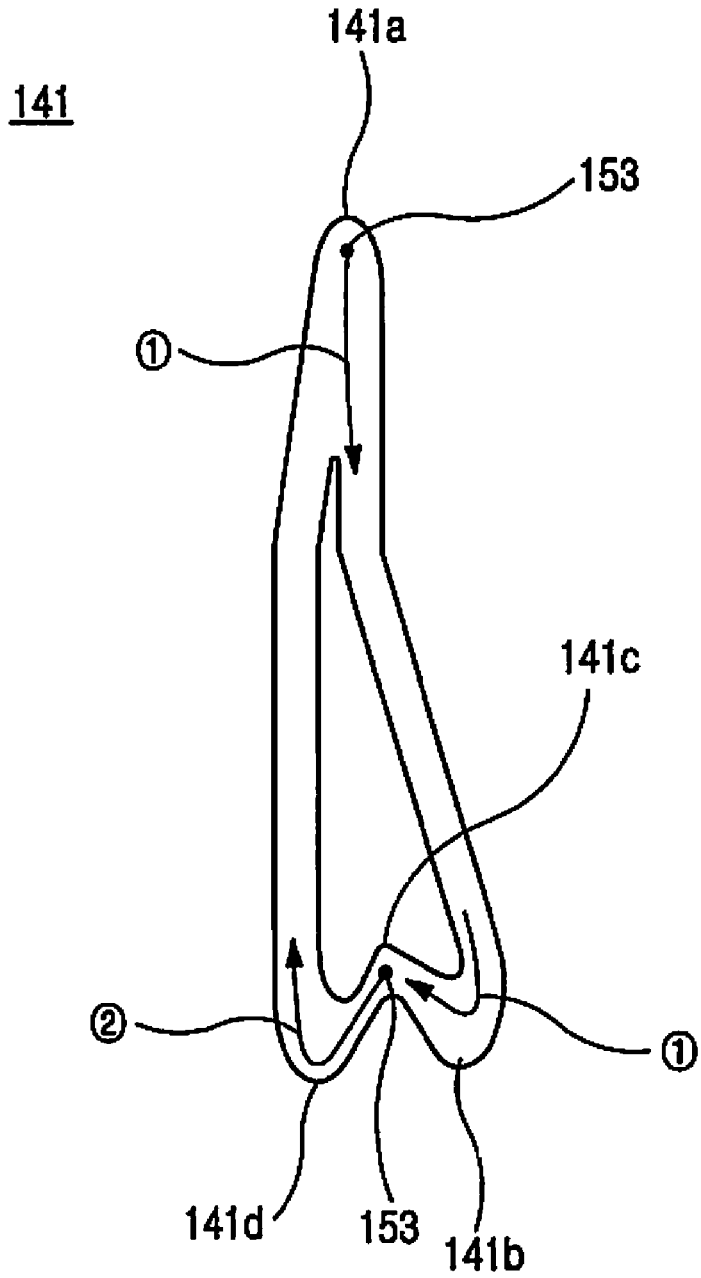
FIG. 5 is a view showing a guide groove of the cam member shown in FIG. 2.
Figure 6:
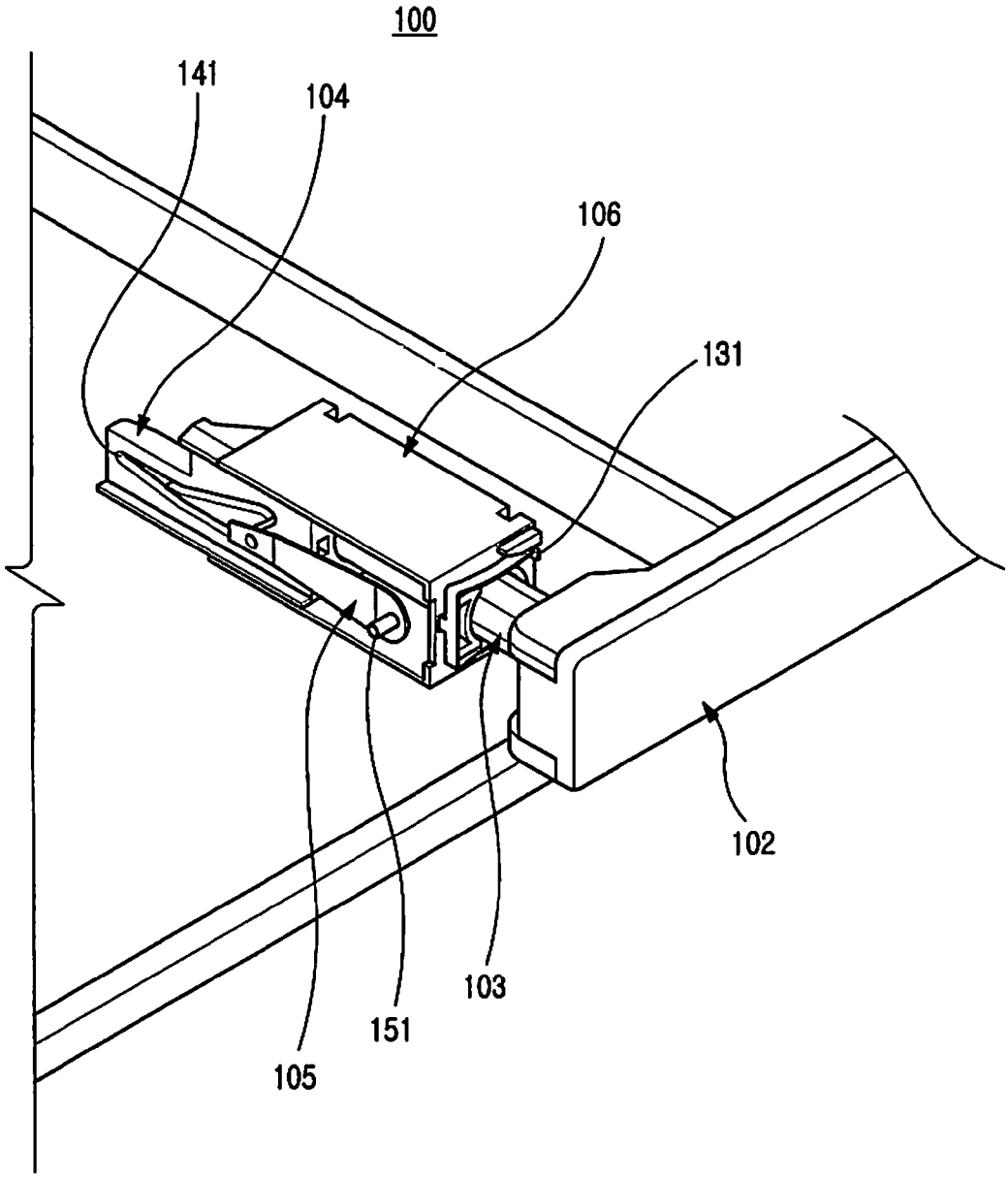
FIGS. 6 and 7 are views illustrating the operation of the antenna assembly shown in FIG. 1.
Figure 7:
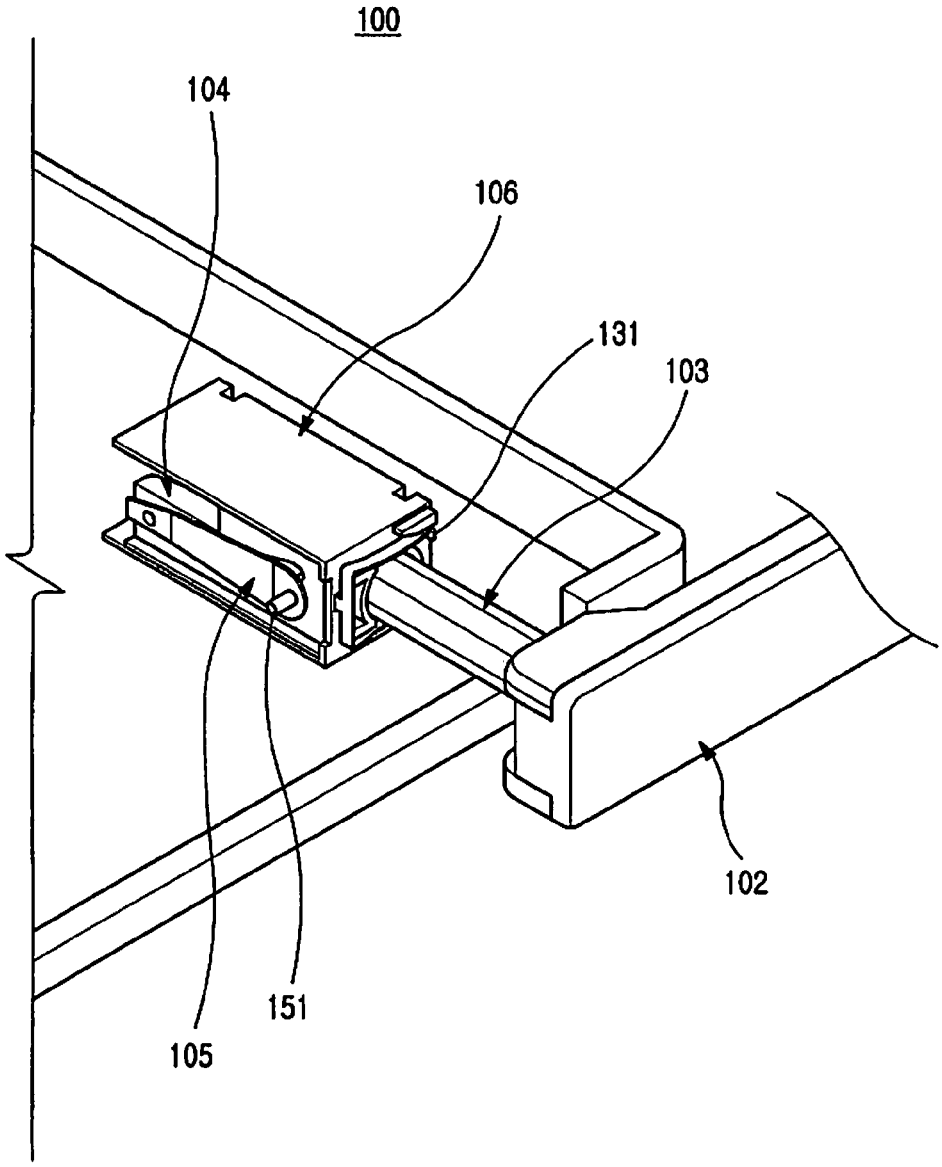

Referring to FIG. 5, the guide groove 141 includes the first and second stopping grooves 141*a* and 141*c*, which are connected to each other to form a loop trajectory having two pathways, and are also asymmetrical to each other. In addition, FIG. 6 shows the antenna housing 102 received in the housing 11 of the portable terminal. FIG. 7 shows the antenna housing 102 withdrawn from the housing 11 of the portable terminal. The operation of the antenna housing 102 of the antenna assembly 100, which is received in and withdrawn from the housing 11 of the portable terminal 10, will now be described with reference to FIGS. 5 to 7.

While the antenna housing 102 is received and locked in the housing 11 of the portable terminal 10, the stopping protrusion 153 is located in the second stopping groove 141*c*. The elastic member 137 provides the elastic force for the cam member 104, so the antenna housing 102 is restrained in the interior of the housing 11 of the portable terminal 10.

When the antenna housing 102 is received and locked in the housing 11 of the portable terminal 10, and when a user presses the antenna housing 102, the cam member 104 moves into the housing 11 of the portable terminal 10, and the stopping protrusion 151 moves clockwise along a trajectory to a first curved part 141*d* from the second stopping groove 141*c* in the guide groove 141. As the cam member 104 moves into the housing 11 of the portable terminal 10, the elastic member 137 accumulates the elastic force.

When the user removes force applied to the antenna housing 102, the connection shaft 103 is withdrawn from the housing 11 of the portable terminal 10 by the elastic force applied to the cam member 104, so the antenna housing 102 is withdrawn from the housing 11 of the portable terminal 10.

While the antenna housing 102 moves from the position in which it has been inserted into the housing 11 of the portable terminal 10, to the position in which it is withdrawn from the housing 11 of the portable terminal 10, the stopping protrusion 153 moves, through the first curved part 141*d*, from the second stopping groove 141*c* to the first stopping groove 141*a* along the trajectory of the guide groove 141 in a direction marked by an arrow ②.

When the stopping protrusion 153 is located in the first stopping groove 141*a*, the antenna housing 102 is not withdrawn from the housing 11 of the portable terminal 10 any more and remains stopped, even though the elastic member 137 applies elastic force to the antenna housing 102.

While the antenna housing 102 is withdrawn from the housing 11 of the portable terminal 10, the user can rotate the antenna housing 102 around the connection shaft 103. Therefore, the user can move the antenna housing 102 in any direction to receive better signals, and withdraw the rod antenna 129 from the antenna housing 102 to use it according to the desire of the user.

In order to receive the antenna housing 102, a receiving groove 19 is formed on the wall of the housing 11 of the portable terminal 10, as shown in FIG. 11. In order to receive the antenna housing 102 in the housing 11 of the portable terminal 10, the user rotates and positions the antenna housing 102 in parallel with the receiving groove 19 of the housing 11 of the portable terminal 10.

When the antenna housing 102 is located in parallel with the receiving groove 19, the user pushes and inserts the antenna housing 102 into the receiving groove 19. The stopping protrusion 153 moves from the first stopping groove 141*a* along the trajectory of the guide groove 141 in a direction marked by an arrow ②. The second curved part 141*b* is formed on the trajectory of the guide groove 141. When the stopping protrusion 153 is located in the second curved part 141*b*, the antenna housing 102 does not move into the receiving groove 19 any more, even though the user presses the antenna housing 102.

When the stopping protrusion 153 is located in the second curved part 141*b*, and when the user removes the force applied to the antenna housing 102, the elastic force from the elastic member 137 causes the antenna housing 102 to move in a direction of being withdrawn from the receiving groove 19. The stopping protrusion 153 moves to the second stopping groove 141*c* along the trajectory in the guide groove 141 in the direction marked by an arrow ①, and stops movement of the antenna housing 102.

Therefore, even though the elastic member 137 applies elastic force to the antenna housing 102, the antenna housing 102 is received and locked in the receiving groove 19.

FIGS. 8 to 11 respectively show the portable terminal 10 having the antenna assembly 100. In FIGS. 8 to 11, the antenna housing 100 is withdrawn from and rotated with respect to the housing 11 of the portable terminal 10. Then, the rod antenna extends out of the antenna housing 100.

The portable terminal 10 has a display device 13 mounted on a side of the housing 11 and a key pad 15 that includes a plurality of keys. The antenna housing 102 of the antenna assembly 100 is mounted on the wall of the housing 11 of the portable terminal 10 in such a manner of being received in and withdrawn from the portable terminal 10. The receiving groove 19 adapted to receive the antenna housing 102 is formed on a wall of the housing 11 of the portable terminal 10.

The user can make a voice call and use functions, such as watching Digital Multimedia Broadcasting (DMB), receiving Global Position Satellite (GPS) signals, etc., through the portable terminal 10. It is present tendency for latest general portable terminals to have embedded antennae for mobile communication service, such as voice call, etc. In order to use functions, such as watching DMB, receiving GPS signals, etc., the user needs separate antenna devices and can use such functions through the antenna assembly 100 of the portable terminal 10.

Even though the portable terminal 10 is for functions, such as watching DMB, receiving GPS etc., it will be understood that the antenna assembly 100 can be used for the portable terminal 10.

As shown in FIG. 8, when antenna housing 102 is received in the receiving groove 19 of the housing 11 of the portable terminal 10, the antenna housing 102 comes into close contact with the receiving groove 19 by the elastic force from the torsion spring 140 so the antenna housing 102 is not withdrawn from the housing 11 of the portable terminal 10. As a result, the aesthetic appearance of the portable terminal 10 is maintained. After pressing and releasing the antenna housing 102 from the housing 11 of the portable terminal 10, the user can rotate the antenna housing 102 in a direction where he/she desires, and can then extend the rod antenna 129 out of the antenna housing 100, if desired.

As described above, the antenna assembly according to the present invention is adapted to be releasably received in the housing 11 of the portable terminal 10, and can be carried while the antenna is received and locked in the housing 11 of the portable terminal 10, thereby making it possible to improve the design and portability of the portable terminal 10. Further, the antenna housing is released from the portable terminal 10 to be used as desired, thereby minimizing damage. In addition, since the antenna housing can be received in and withdrawn from the portable terminal 10 by pressing operation of a user, there is an advantage in that it is possible to easily operate the antenna assembly and to ensure better communication quality of the portable terminal 10.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna assembly for a portable terminal, the antenna assembly comprising:

an antenna housing releasably received in the portable terminal;

a cam member having at least one stopping groove formed on a surface of the cam member, and connected to the antenna housing to move linearly and reciprocally in the portable terminal;

a guide member enclosing the cam member, which moves linearly and reciprocally in the guide member;

a stopper rotatably coupled to the guide member and selectively engaged with the stopping groove to interlock with the cam member; and an elastic member providing elastic force in a direction where the antenna housing is withdrawn from the portable terminal, wherein the stopper is engaged with the stopping groove so as to restrain the antenna housing in an interior of the portable terminal when the antenna housing is received and locked in the portable terminal.

2. The antenna assembly as claimed in claim 1, wherein the stopper comprises a rotation pin formed on a surface of the stopper, and a stopping protrusion formed on another surface of the stopper, and wherein as the rotation pin rotates in the portable terminal, the stopper rotates in the portable terminal and the stopping protrusion selectively engages with the stopping groove.

3. The antenna assembly as claimed in claim 1, further comprising a guide groove formed on the cam member to have a closed curve trajectory, wherein the stopping groove is formed in the guide groove.

4. The antenna assembly as claimed in claim 3, wherein a part of the stopper moves along the guide groove as the antenna housing is received in and withdrawn from the portable terminal.

5. The antenna assembly as claimed in claim 1, further comprising a connection shaft extending from the antenna housing to the interior of the portable terminal, wherein the cam member is fixed to the connection shaft.

6. The antenna assembly as claimed in claim 5, wherein the elastic member is supported by the cam member to provide elastic force in a direction where the connection shaft is withdrawn from the portable terminal.

7. The antenna assembly as claimed in claim 5, wherein the antenna housing is rotatably coupled to the end of the connection shaft.

8. The antenna assembly as claimed in claim 7, further comprising a torsion spring mounted on an end of the connection shaft, wherein when the antenna housing is received and locked in the portable terminal, the torsion spring provides elastic force in a direction where the antenna housing comes into close contact with the interior of the portable terminal.

9. The antenna assembly as claimed in claim 5, wherein the connection shaft is rotatably coupled to the portable terminal so the antenna housing rotates about the connection shaft.

10. The antenna assembly as claimed in claim 9, further comprising a plate spring pressing an outer peripheral surface of the connection shaft, wherein as the plate spring presses the outer peripheral surface of the connection shaft, rotation of the connection shaft is limited.

11. The antenna assembly as claimed in claim 10, wherein the outer peripheral surface of the connection shaft has a plurality of flat surfaces arranged in a circumferential direction, and rotation of the connection shaft is stopped as the plate spring presses the outer flat peripheral surface of the connection shaft.

12. The antenna assembly as claimed in claim 10, wherein the outer peripheral surface of the connection shaft has a plurality of grooves arranged in a circumferential direction, and rotation of the connection shaft is stopped as the plate spring presses the groove of the outer peripheral surface of the connection shaft.

13. The antenna assembly as claimed in claim 1, wherein the guide member is mounted on the interior of the portable terminal.

14. The antenna assembly as claimed in claim 13, further comprising a cam housing mounted on the interior of the portable terminal to enclose the guide member, the stopper being rotatably coupled to the interior of the cam housing.

* * * * *